US010746513B1

(12) United States Patent
Liu

(10) Patent No.: US 10,746,513 B1
(45) Date of Patent: Aug. 18, 2020

(54) POWER FREE STEP AUTO RESET CLAY THROWER

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 16/595,555

(22) Filed: Oct. 8, 2019

(51) Int. Cl.

| | |
|---|---|
| ***F41J 9/18*** | (2006.01) |
| ***F41J 9/22*** | (2006.01) |
| ***F41J 9/24*** | (2006.01) |
| ***F41J 9/20*** | (2006.01) |

(52) U.S. Cl.
CPC . *F41J 9/20* (2013.01); *F41J 9/18* (2013.01); *F41J 9/24* (2013.01)

(58) Field of Classification Search
CPC . F41J 9/18; F41J 9/20; F41J 9/22; F41J 9/24; F41J 9/30
See application file for complete search history.

(56) References Cited

U.S. PATENT DOCUMENTS 2,193,266 A * 3/1940 Betts ..... F41J 9/20 124/8
6,062,207 A * 5/2000 Underhill ..... F41J 9/20 124/8
7,263,986 B2 * 9/2007 Lovell ..... F41J 9/24 124/9
10,088,282 B2 * 10/2018 Laporte ..... F41J 9/22
2017/0052003 A1 * 2/2017 Liu ..... F41J 9/18

* cited by examiner

*Primary Examiner* — John A Ricci
(74) *Attorney, Agent, or Firm* — Demian K. Jackson; Jackson IPG PLLC

(57) ABSTRACT

A power free step auto reset clay thrower consisting of a base, a stepping rod, a support, a throwing arm holder, a throwing arm and an elastic member is disclosed. When the stepping rod is depressed, the throwing arm is forced by a first spring to move a link and a first linking member in turning the throwing arm forward for causing generation of a centrifugal force to throw a clay away from the throwing arm. When the throwing arm is thrown forward, the eccentric pivot joint stretches the elastic member. When the pedal is stopped, the elastic member restores the pedal, and the throwing arm is also returned to its original position where the rear side of the sidewall of the throwing arm is stopped by the top side of the trigger arm. Since there is no need to additionally install a motor for driving the throwing arm to restore the position, the invention has the advantages of saving power and environmental protection and can save motor assembly and component costs.

3 Claims, 8 Drawing Sheets

POWER FREE STEP AUTO RESET CLAY THROWER

BACKGROUND AND SUMMARY OF THE INVENTION

The present invention relates to clay shooting supplies and more specifically, to a power free step auto reset clay thrower, which uses an elastic member to automatically restores the position of the throwing arm after throwed the clay.

U.S. Pat. No. 6,062,207 discloses a clay target launcher designed to be operated by a single person during target practice, which includes a base with a rotatable launching arm mounted thereon, which accommodates a clay target, a trigger to latch the arm in a cocked position and movable to release the arm, a foot pedal, a spring mounted between the foot pedal and the throwing arm to apply rotational bias to the arm, and a trigger release actuator attached between the foot pedal and the trigger.

This prior art design still has drawbacks as follows:

1. After the throwing arm throws the clay target, the user needs to manually return the throwing arm, enabling the trigger catch to be stopped by the trigger arm.

2. It needs to manually load a clay onto the throwing arm after each throwing operation.

Therefore, the aforementioned U.S. Pat. No. 6,062,207 has the problem of operational trouble and inconvenience that needs to be improved.

Further, US 2017/0052003 discloses a non-pedal type clay thrower, which teaches the use of a motor to turn the throwing arm. However, since the motor is power operated, this prior art design not only wastes electricity but also does not comply with the principle of environmental protection. Furthermore, in order to assemble the motor, it also increases the assembly cost and component cost of the motor-related components. An improvement is needed.

Further, U.S. application Ser. No. 16/253,359, filed by the present inventor, discloses a step auto clay thrower, which is so configured that when the pedal is depressed, the tilting bracket extends the second spring, at the same time, the first connecting member pulls the first spring to bias the trigger arm. When the top side of the trigger arm is biased away from the rear side of the sidewall of the throwing arm, the elastic restoring energy of the second spring drives the link to move the first linking member, the shaft and the throwing arm to turn forward. The centrifugal force thus generated force the throwing arm to throw the clay. Thereafter, the motor shaft of the mini motor rotates the shaft rotated through an angle but not reached the original position, thereby returning throwing arm.

However, the use of a mini motor for transmission is not only a waste of power and is not environmentally friendly, but also has a complicated structure for transmission through the mini motor. Further, according to this design, the motor shaft of the mini motor is connected with the top side of the shaft by a first one-way clutch for rotating the shaft in one direction to return the throwing arm. The first one-way clutch comprises a second bearing block and a first one-way bearing or a first ratchet. The motor shaft of the mini motor is connected to one side of the second bearing block. An opposite side of the second bearing block is connected to the first one-way bearing or first ratchet. The first one-way bearing or first ratchet is connected with a top end of the shaft by a fourth fastener. The first bearing block is connected with a second one-way clutch and then movable connected to an opposing bottom end of the shaft for enabling the shaft to be rotated in one direction. The second one-way clutch can be formed of a second one-way bearing or a second ratchet. Therefore, the assembly and component costs of the aforementioned mini motor-operated step auto clay thrower are relatively high.

The present invention has been accomplished under the circumstances in view. It is therefore the main object of the present invention to provide a power free step auto reset clay thrower, which is so configured that when the throwing arm throws the clay, the elastic restoring energy of an elastic member automatically restores the position of the throwing arm without the assistance of a motor, and therefore, the invention can save electricity and meet the principle of environmental protection.

It is therefore another object of the present invention to provide a power free step auto reset clay thrower, which does not need to additionally install a motor and the related transmission components for driving the throwing arm, thereby saving motor assembly and related component costs.

DETAILED DESCRIPTION OF THE INVENTION

Figure 1:
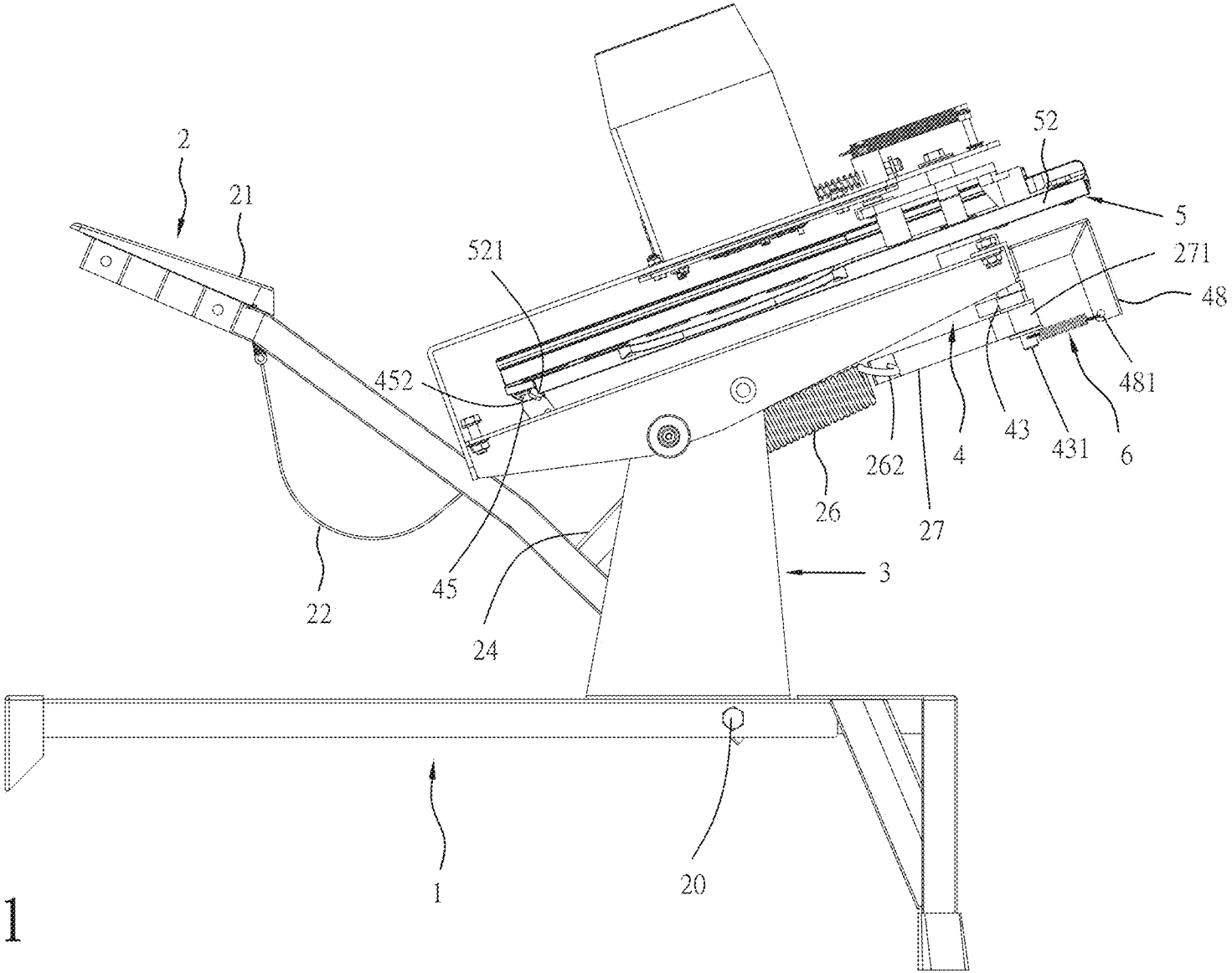
FIG. 1 is a side assembly view of a power free step auto reset clay thrower in accordance with the present invention.
Figure 2:
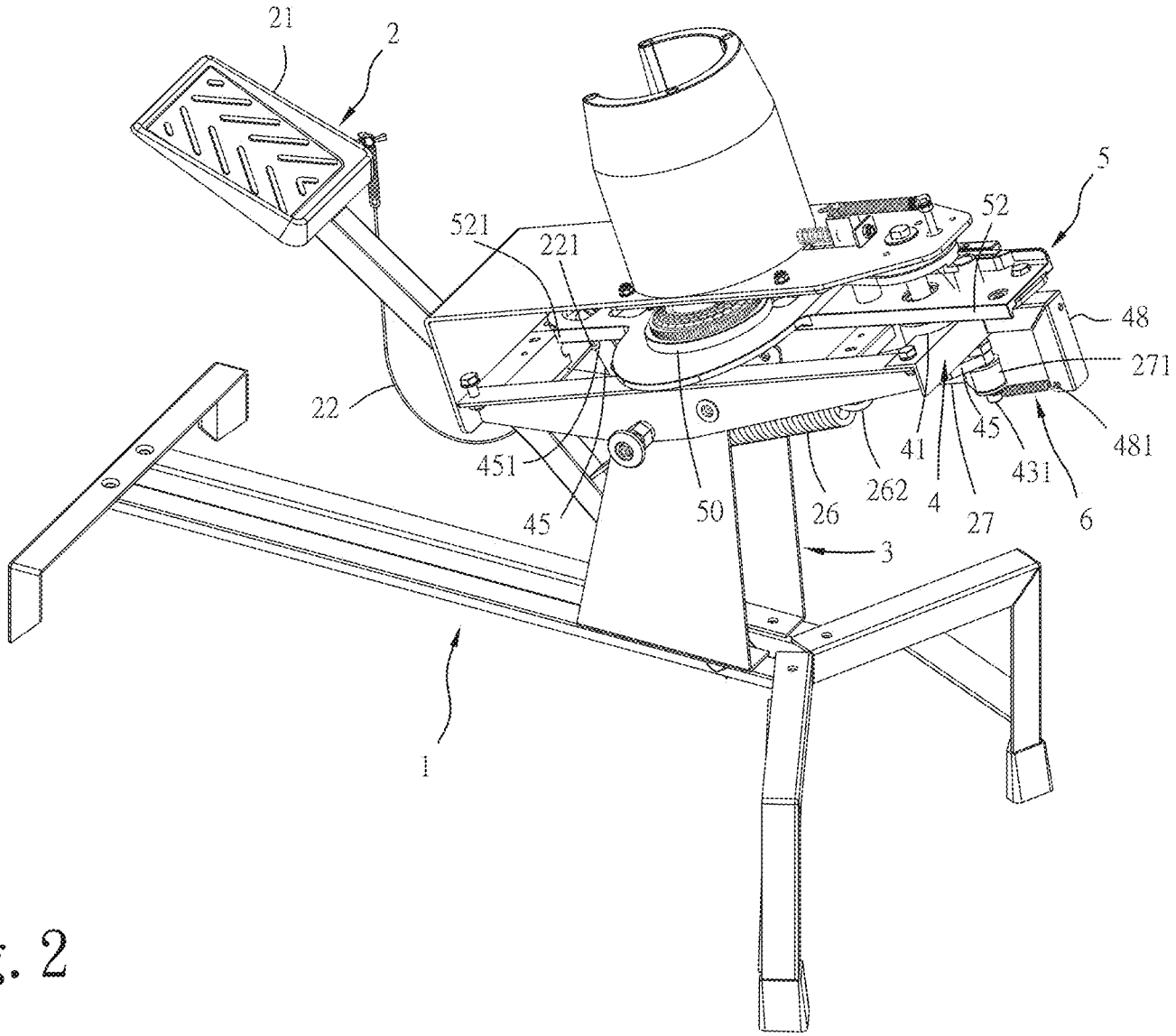
FIG. 2 is an oblique top elevational view of the power free step auto reset clay thrower in accordance with the present invention.
Figure 3:
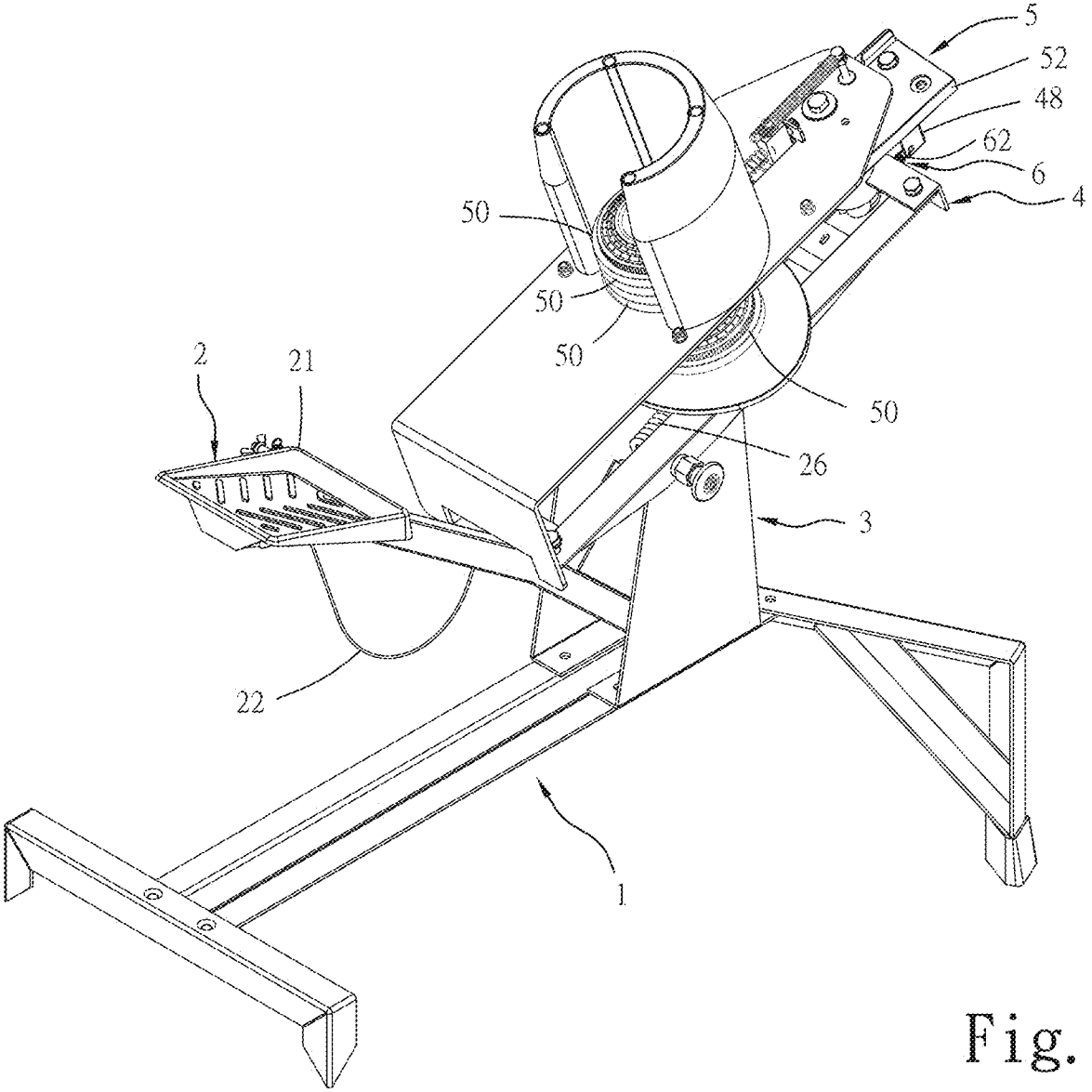
FIG. 3 corresponds to FIG. 2 when viewed from another angle.
Figure 4:
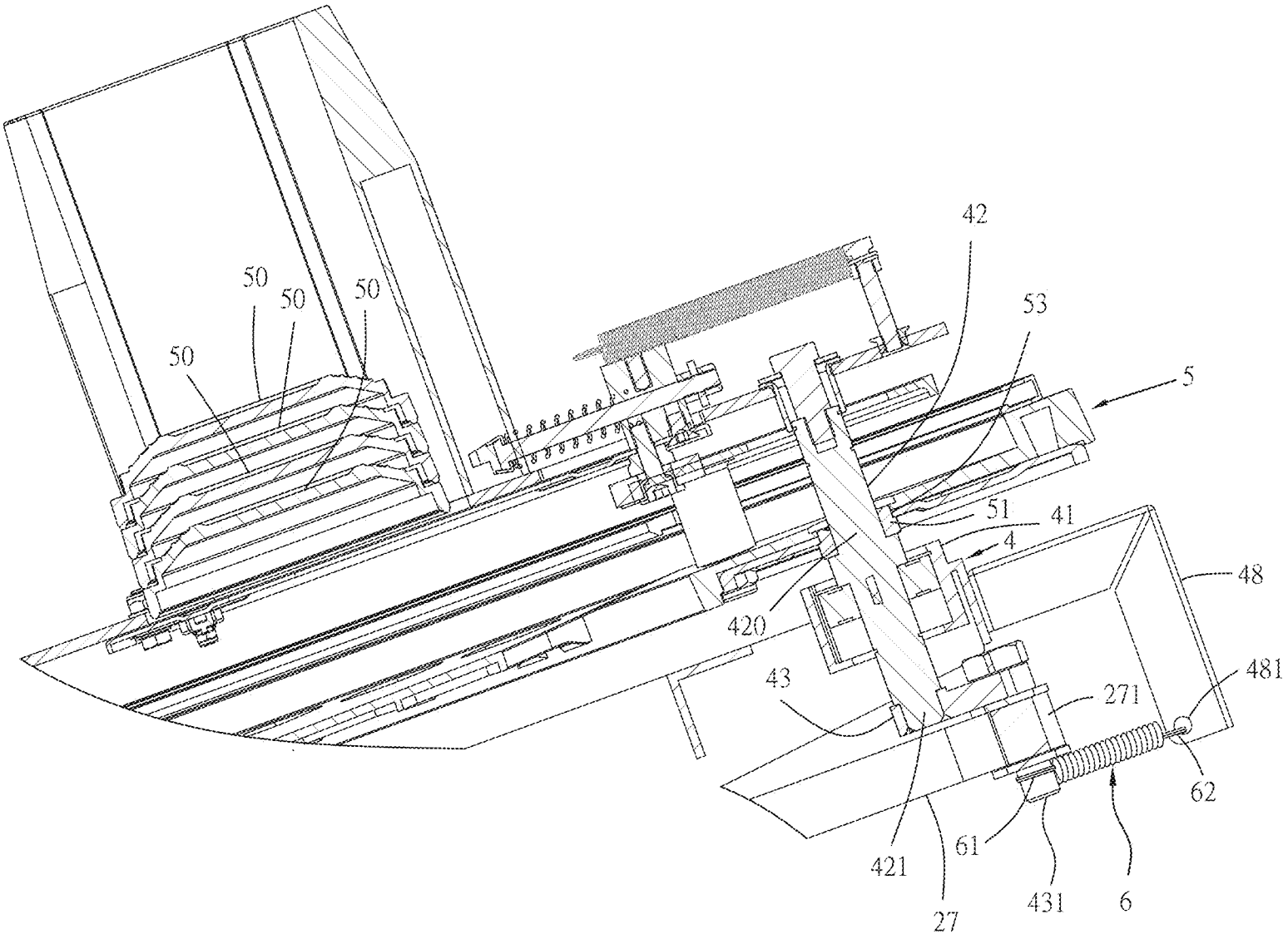
FIG. 4 is a sectional view, in an enlarged scale, of a part of the power free step auto reset clay thrower in accordance with the present invention.
Figure 5:
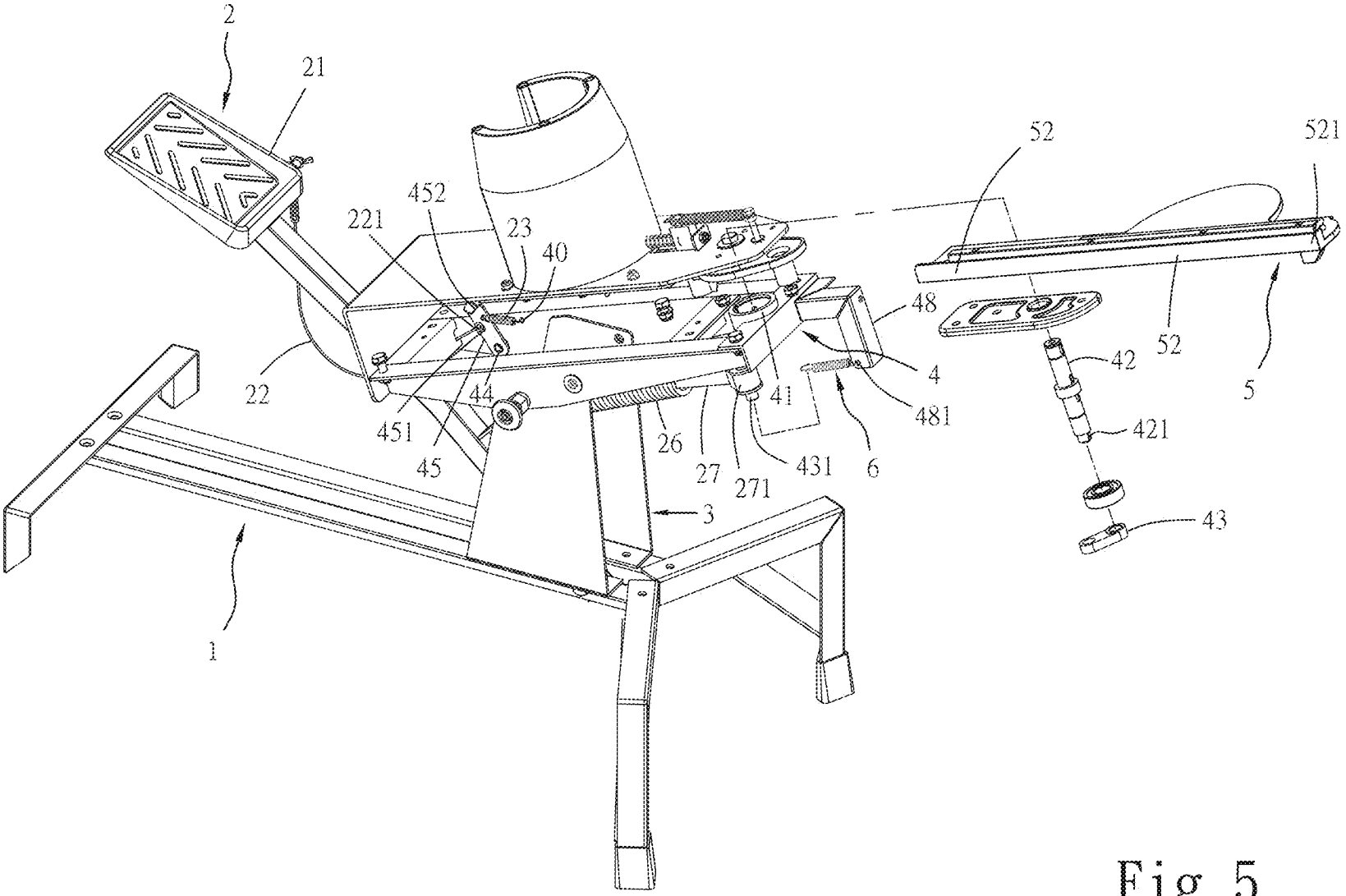
FIG. 5 is an exploded view of the power free step auto reset clay thrower in accordance with the present invention.
Figure 6:
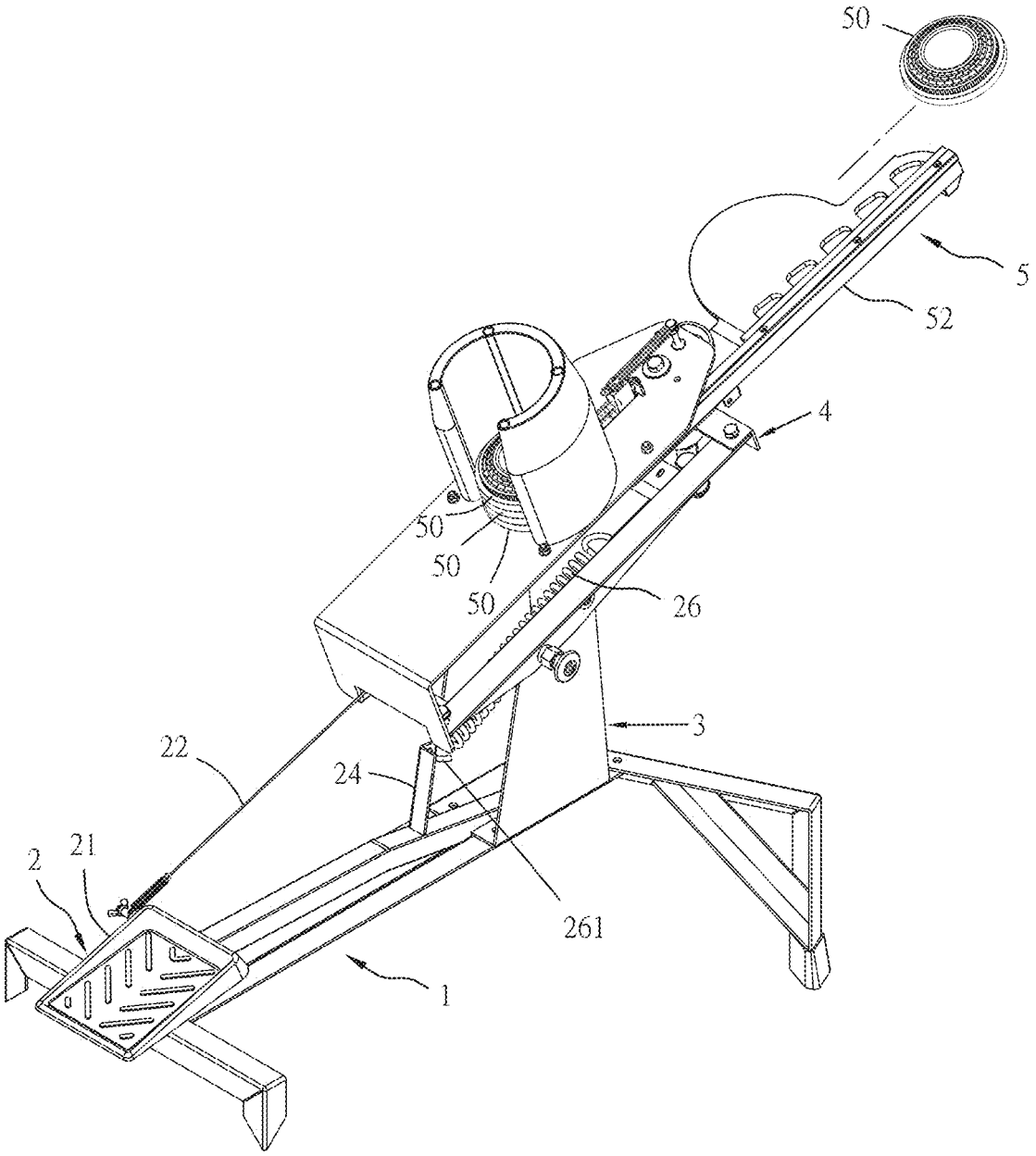
FIG. 6 is a schematic elevational view of the present invention, illustrating the pedal depressed and the throwing arm throwed the clay.
Figure 7:
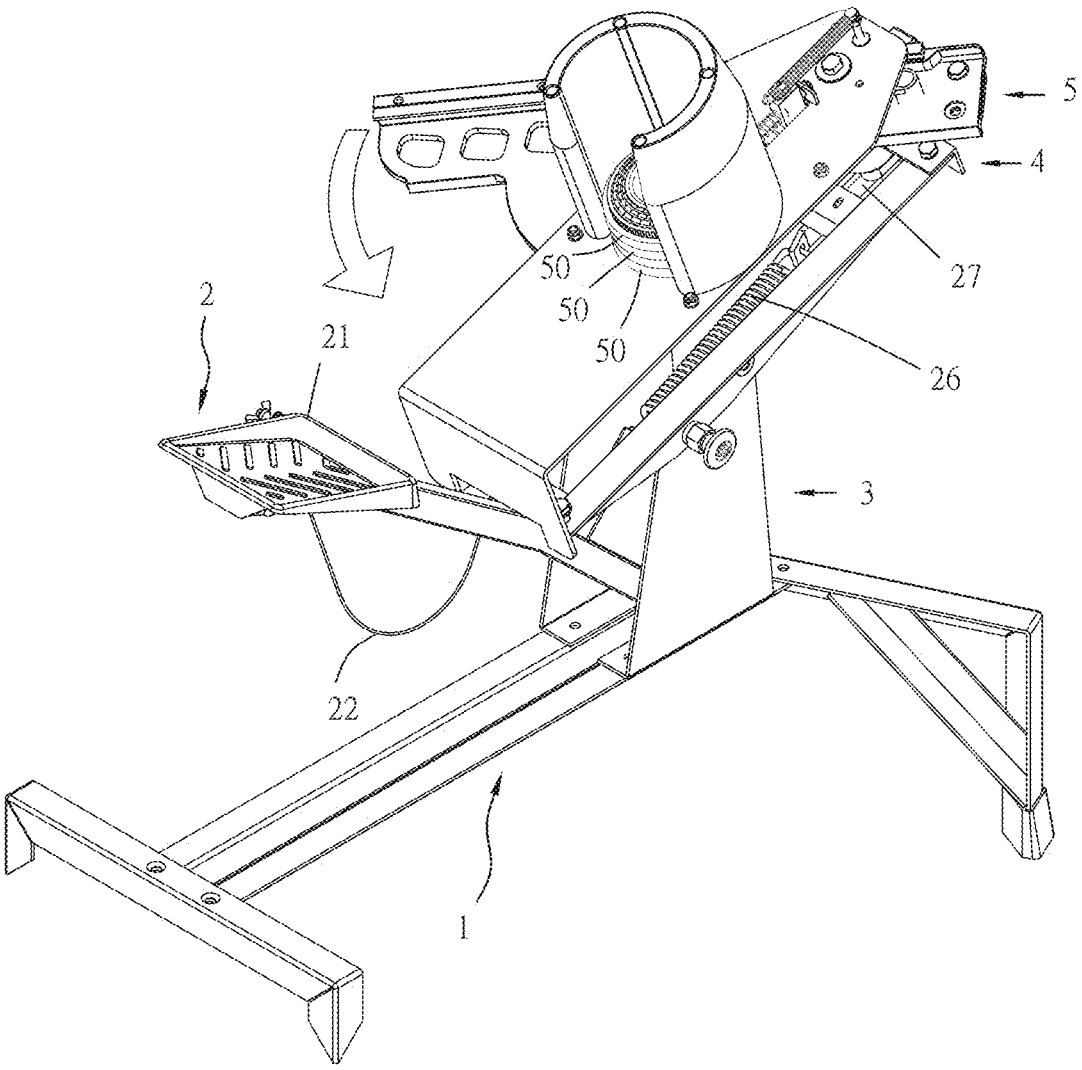
FIG. 7 is a schematic elevational view of the present invention, illustrating the pedal depressed, the throwing arm biased by the elastic member through an angle after throwed the clay.
Figure 8:
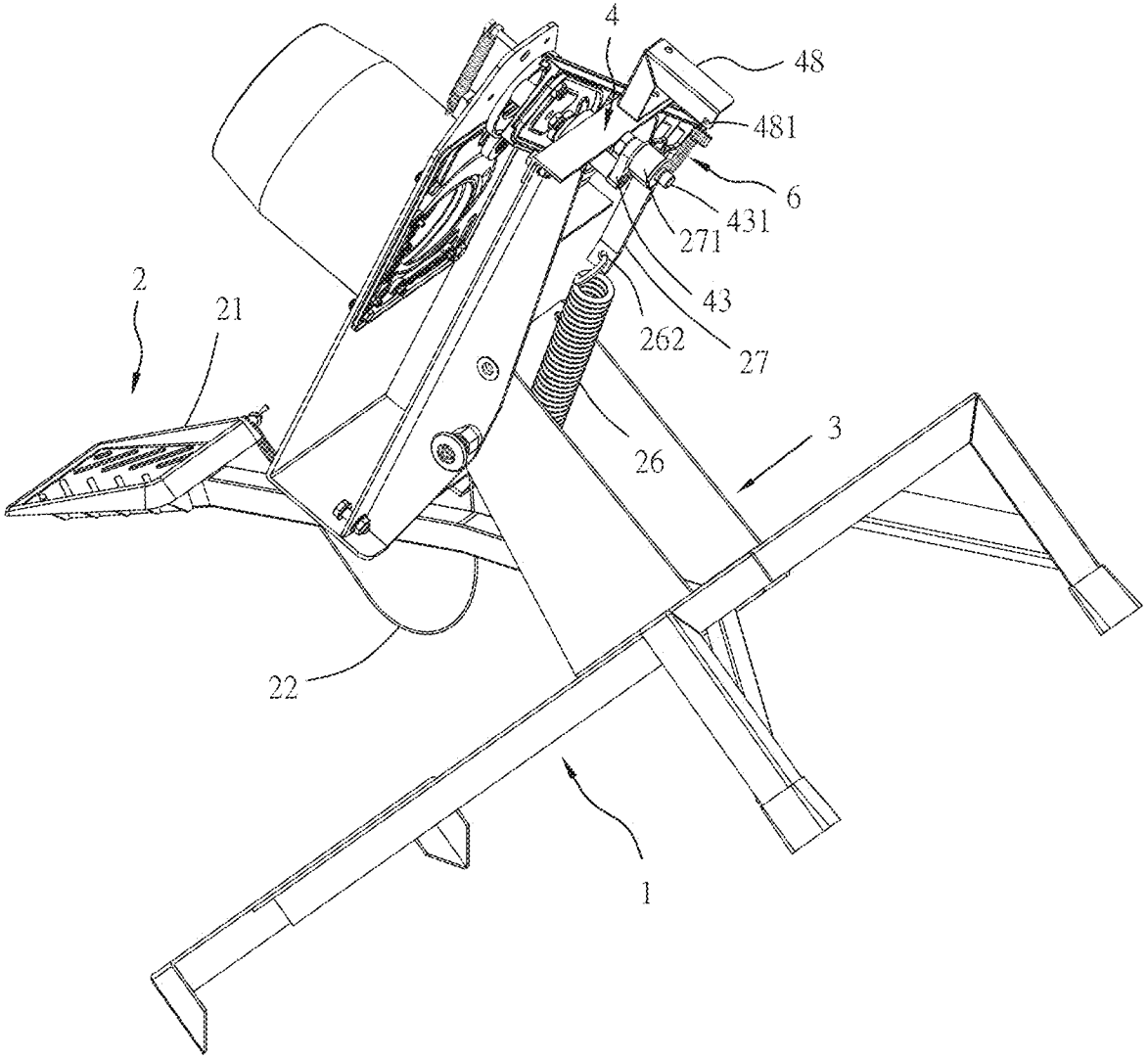
FIG. 8 corresponds to FIG. 7 when viewed from another angle.

Referring to FIGS. 1-8, a power free step auto reset clay thrower comprises:

a base 1;

a stepping rod 2 having a front end thereof pivotally connected to a front side of the base 1 by a first pivot member 20, an opposing rear end thereof connected with a pedal 21, the pedal 21 being connected to one end of a first connecting member 22, the stepping rod 2 having a front part thereof connected with a tilting bracket 24, the tilting bracket 24 being connected to one end 261 of a first spring 26 (see FIG. 6), the first spring 26 having an opposite end 262 thereof connected to one end of a link 27;

a support 3 affixed to a front top side of the base 1;

a throwing arm holder 4 mounted on a top side of the support 3, comprising a first bearing block 41 located at a front side thereof (see FIGS. 1, 2, 4 and 5), a shaft 42 movably coupled to the first bearing block 41 (see FIG. 4 and FIG. 5) with a bottom end 421 thereof (see FIG. 2 and FIG. 4) connected with a first linking member 43 (see FIG. 4), the first linking member 43 being pivotally connected to an opposite end 271 of the link 27 by an eccentric pivot joint 431 (see FIGS. 1, 2 and 4), the eccentric pivot joint 431 being offset from the center of the shaft 42 (see FIG. 4), the throwing arm holder 4 having a back side thereof pivotally connected with a trigger arm 45 by a second pivot member 44 (see FIGS. 1, 2 and 5), the trigger arm 45 having one side 451 thereof connected to an opposite end 221 of the first connecting member 22 (see FIG. 5) and a part thereof connected to an inside wall 40 of the throwing arm holder 4 by a second spring 23;

a throwing arm 5 having a coupling groove 53 located on a front side thereof and connected with a second connecting member 51 (see FIG. 4) that is fixed connected with a top side 420 of the shaft 42 by welding (see FIG. 4), a rear top side thereof configured for the placement of a clay 50 (see FIG. 3) and a rear side 521 of a sidewall 52 thereof (see FIG. 4) configured for stopping by a top side 452 of the trigger arm 45; and an elastic member 6 having one end 61 (see FIG. 4) thereof connected to the eccentric pivot joint 431 and an opposite end 62 thereof (see FIG. 4) connected to a fixing portion 481 at the front side of the throwing arm holder 4.

Thus, when the pedal 21 is depressed, the tilting bracket 24 extends the first spring 26, at the same time, the first connecting member 22 biases the trigger arm 45 to stretch the second spring 23. When the top side 452 of the trigger arm 45 is biased away from the rear side 521 of the sidewall 52 of the throwing arm 5, the elastic restoring energy of the first spring 26 drives the link 27 to move the first linking member 43, the shaft 42 and the throwing arm 5 to turn forward. The centrifugal force thus generated forces the throwing arm 5 to throw the clay 50 (see FIG. 6). When the throwing arm 5 is thrown forward, the eccentric pivot joint 431 stretches the elastic member 6. When the pedal 21 is stopped, the elastic restoring energy of the elastic member 6 returns the pedal 21 upwardly to its original position, and the throwing arm 5 is also rotated and returned to its original position (refer to FIGS. 7 and 8 where the throwing arm has not been completely restored) where the rear side 521 of the sidewall 52 of the throwing arm 5 is stopped by the top side 452 of the trigger arm 45 (refer to FIGS. 1 and 2). Since there is no need to additionally install a motor for driving the throwing arm 5 to restore the position, the invention has the advantages of saving power and environmental protection and can save motor assembly and component costs.

Furthermore, the fixing portion 481 at the front side of the throwing arm holder 4 is disposed above a bracket 48, and the bracket 48 is integrally formed on the front side of the throwing arm holder 4 or fixedly connected to the front side of the throwing arm holder 4 by locking, riveting or other connection measure.

Furthermore, the aforesaid elastic member 6 can be a spring, a bungee cord, or a rubber band.

In conclusion, the invention has the advantages as follows:

1. When the throwing arm 5 throws the clay 50, the elastic restoring energy of the elastic member 6 automatically returns the throwing arm 5 to its original position without the assistance of a motor, and therefore, the invention can save electricity and meet the principle of environmental protection.

2. Since there is no need to additionally install a motor and the related transmission components for driving the throwing arm 5, the invention can save motor assembly and related component costs.

What is claimed is:

1. A power free step auto reset clay thrower, comprising:

a base;

a stepping rod having a front end thereof pivotally connected to a front side of said base by a first pivot member and an opposing rear end thereof connected with a pedal, said pedal being connected to one end of a first connecting member, said stepping rod having a front part thereof connected with a tilting bracket, said tilting bracket being connected to one end of a first spring, said first spring having an opposite end thereof connected to one end of a link;

a support affixed to a front top side of said base;

a throwing arm holder mounted on a top side of said support, said throwing arm holder comprising a first bearing block located at a front side thereof and a shaft movably coupled to a first bearing block with a bottom end thereof connected with a first linking member, said first linking member being pivotally connected to an opposite end of said link by an eccentric pivot joint, said eccentric pivot joint being offset from the center of said shaft, the throwing arm holder having a back side thereof pivotally connected with a trigger arm by a second pivot member, said trigger arm having one side thereof connected to an opposite end of said first connecting member and a part thereof connected to an inside wall of said throwing arm holder by a second spring;

a throwing arm having a coupling groove located on a front side thereof and connected with a second connecting member that is fixed connected with a top side of said shaft by welding, a rear top side thereof configured for the placement of a clay and a rear side of a sidewall thereof configured for stopping by a top side of said trigger arm; and an elastic member having one end thereof connected to said eccentric pivot joint and an opposite end thereof connected to a fixing portion at the front side of said throwing arm holder;

when the pedal is depressed, the tilting bracket extends the first spring, at the same time, the first connecting member biases the trigger arm to stretch the second spring; when the top side of the trigger arm is biased away from the rear side of the sidewall of the throwing arm, the elastic restoring energy of the first spring drives the link to move the first linking member, the shaft and the throwing arm to turn forward; the centrifugal force thus generated forces the throwing arm to throw the clay; when the throwing arm is thrown forward, the eccentric pivot joint stretches the elastic member; when the pedal is stopped, the elastic restoring energy of the elastic member returns the pedal upwardly to its original position, and the throwing arm is also rotated and returned to its original position where the rear side of the sidewall of the throwing arm is stopped by the top side of the trigger arm.

2. The power free step auto reset clay thrower as claimed in claim 1, wherein said fixing portion of said throwing arm holder is disposed above a bracket that is integrally formed on the front side of said throwing arm holder or fixedly connected to the front side of said throwing arm holder by locking or riveting.

3. The power free step auto reset clay thrower as claimed in claim 1, wherein said elastic member is selectively a spring, a bungee cord, or a rubber band.

* * * * *